United States Patent [19]

Kowalski

[11] 4,037,098

[45] July 19, 1977

[54] SWIVEL CONNECTOR

[75] Inventor: Joseph W. Kowalski, Florissant, Mo.

[73] Assignee: B-Line Systems, Inc., Highland, Ill.

[21] Appl. No.: 610,644

[22] Filed: Sept. 5, 1975

[51] Int. Cl.[2] ..... F21S 1/06; F21S 3/06

[52] U.S. Cl. ..... 240/78 R; 240/73 JC; 240/81 BE; 240/DIG. 5; 248/323

[58] Field of Search ..... 240/78 B, 78 HA, 78 R, 240/73 BJ, 73 BA, 73 JC, 81 BD, 81 BE, 81 BC, DIG. 5; 248/349, 323, 324

[56] References Cited

U.S. PATENT DOCUMENTS

| | | | |
|---|---|---|---|
| 1,697,037 | 1/1929 | Witz | 240/DIG. 5 |
| 2,907,545 | 10/1959 | Beck et al. | 240/78 R X |
| 3,182,187 | 5/1965 | Gellert | 240/78 R |

*Primary Examiner*—Richard A. Wintercorn
*Attorney, Agent, or Firm*—Koenig, Senniger, Powers and Leavitt

[57] ABSTRACT

A swivel connector assembly for mounting a lighting fixture or the like comprising a body member having a generally spherical surface portion, an opening through the body member at the center of this spherical surface portion, and a swivel member having a generally spherical surface portion engaging that of the body member for swinging, sliding movement relative thereto. The swivel member has a stem which extends through the opening, this stem being adapted to have a length of conduit or the like secured thereto. The swivel member further has a passage therethrough for reception of one or more wires which pass through the conduit so as to supply power to the lighting fixture. The connector further has a pin and slot arrangement for limiting rotation of the swivel member about its longitudinal axis relative to the body member so as to permit the conduit to be threaded into he swivel member and to prevent twisting of the wires.

8 Claims, 7 Drawing Figures

SWIVEL CONNECTOR

BACKGROUND OF THE INVENTION

This invention relates to a swivel connector assembly for mounting a lighting fixture or the like, and more particularly to a swivel conduit connector through which wires to the lighting fixture are routed and which supports the lighting fixture.

Generally, known swivel connector assemblies include a stationary body adapted to be secured to overhead structure and a swing member carried by the body for swinging movement relative thereto. Typically, the swing member is free to swing only in one plane and does not permit the swing member and conduit to swing in any other direction. This poses difficulties when mounting the swing connector on a sloped, overhead structure because the swing plane of the connector has to be aligned with the slope of the overhead structure to allow the light fixture to hang vertically from the connector. In hanging lighting fixtures in factories and warehouses where they may be inadvertently bumped, as by a fork lift truck or the like, these prior art swing connectors would rigidly hold the lighting fixture from swinging unless it is bumped along its swing plane. Because these prior art swing connectors do not permit the lighting fixture to swing in all directions, damage to the lighting fixture upon being bumped is likely. Oftentimes when a lighting fixture supported by prior art swing connectors is bumped the swing member is jammed into the body of the connector. This may damage wiring within the connector.

SUMMARY OF THE INVENTION

Among the several objects of this invention may be noted the provision of a swivel assembly for mounting a lighting fixture or the like which is free to swing in any direction from an equilibrium position; the provision of such a swivel connector assembly which protects itself and wiring routed therethrough from damage caused by twisting of portions of the swivel connector relative to one another; the provision of such a swivel connector assembly which enables a conduit supported therefrom to hang substantially vertically even if its supporting structure is not level; the provision of such a swivel connector in which all parts of the connector are electrically common with one another; the provision of such a connector which holds parts thereof from rotating relative to one another as a conduit is secured (i.e., threaded) thereto so as to prevent damage to wiring in the connector; the provision of such a swivel connector which prevents wiring therewithin from being damaged in the event a part thereof is jammed into the body of the connector, as may be occasioned by the lighting fixture supported thereby being inadvertently bumped; and the provision of such a swivel connector which may be readily installed and which is economical to manufacture. Other objects and features of this invention will be in part apparent and in part pointed out hereinafter.

Briefly, a swivel connector assembly of this invention for mounting a lighting fixture or the like comprises a body member having a generally spherical surface portion, an opening through the body member at the center of the spherical surface portion and a swivel member having a generally spherical surface portion interengaging that of the body for swinging sliding movement relative thereto. The swivel member has a stem which extends through the opening, this stem being adapted to have a length of conduit or the like secured thereto. The swivel member has a passage therethrough for reception of one or more wires which pass through the conduit so as to supply power to the lighting fixture. The swivel assembly further includes means for limiting rotation of the swivel member about its longitudinal axis relative to the body member.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
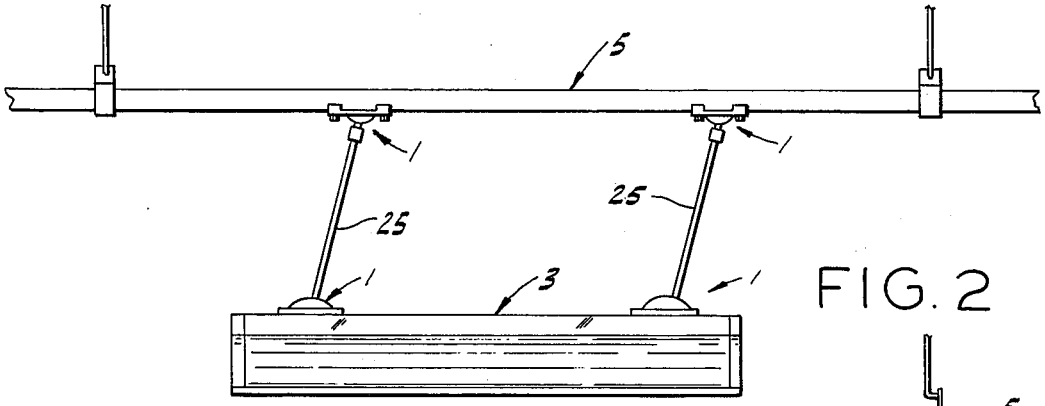
FIG. 1 is a side elevational view of a lighting fixture supported by two pairs of swivel connectors of this invention, the lighting fixture being shown swung in one direction from its equilibrium position in which the conduits are vertical.
Figure 2:
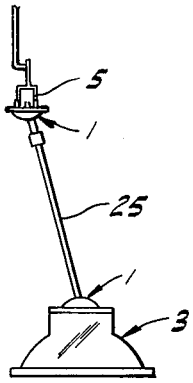
FIG. 2 is an end elevational view of the lighting fixture and swivel connectors of FIG. 1 with the lighting fixture swung in another direction from its equilibrium position.
Figure 5:
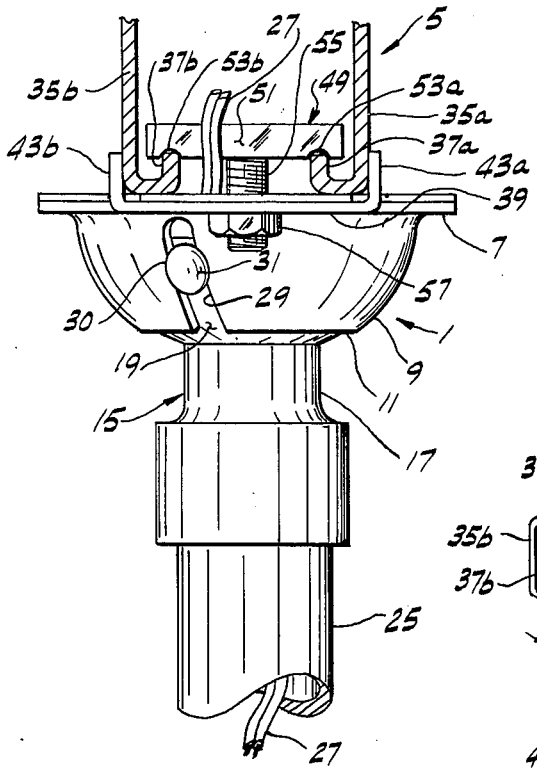
FIG. 5 is an end view of the swivel connector shown in FIG. 3.
Figure 3:
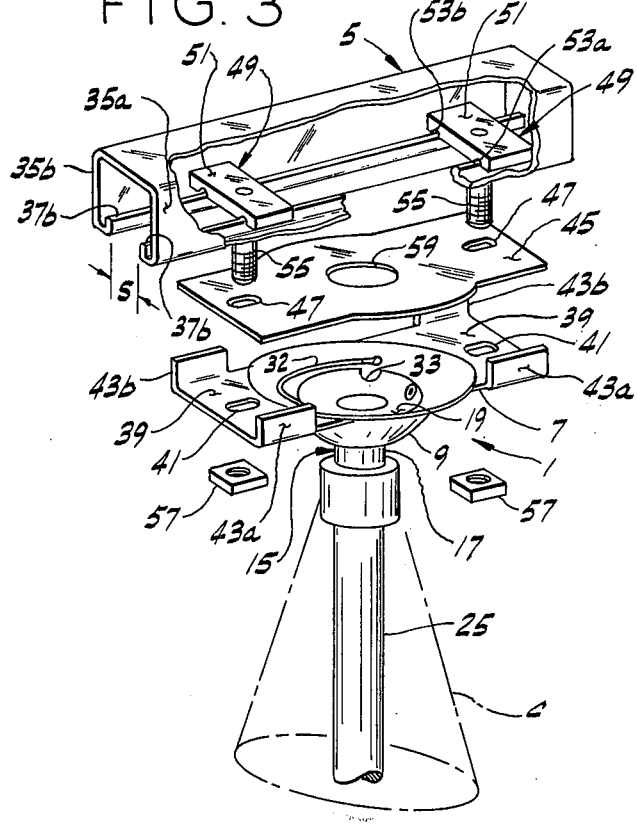
FIG. 3 is an exploded perspective view of a first embodiment of the swivel connector of this invention with parts broken away.
Figure 4:
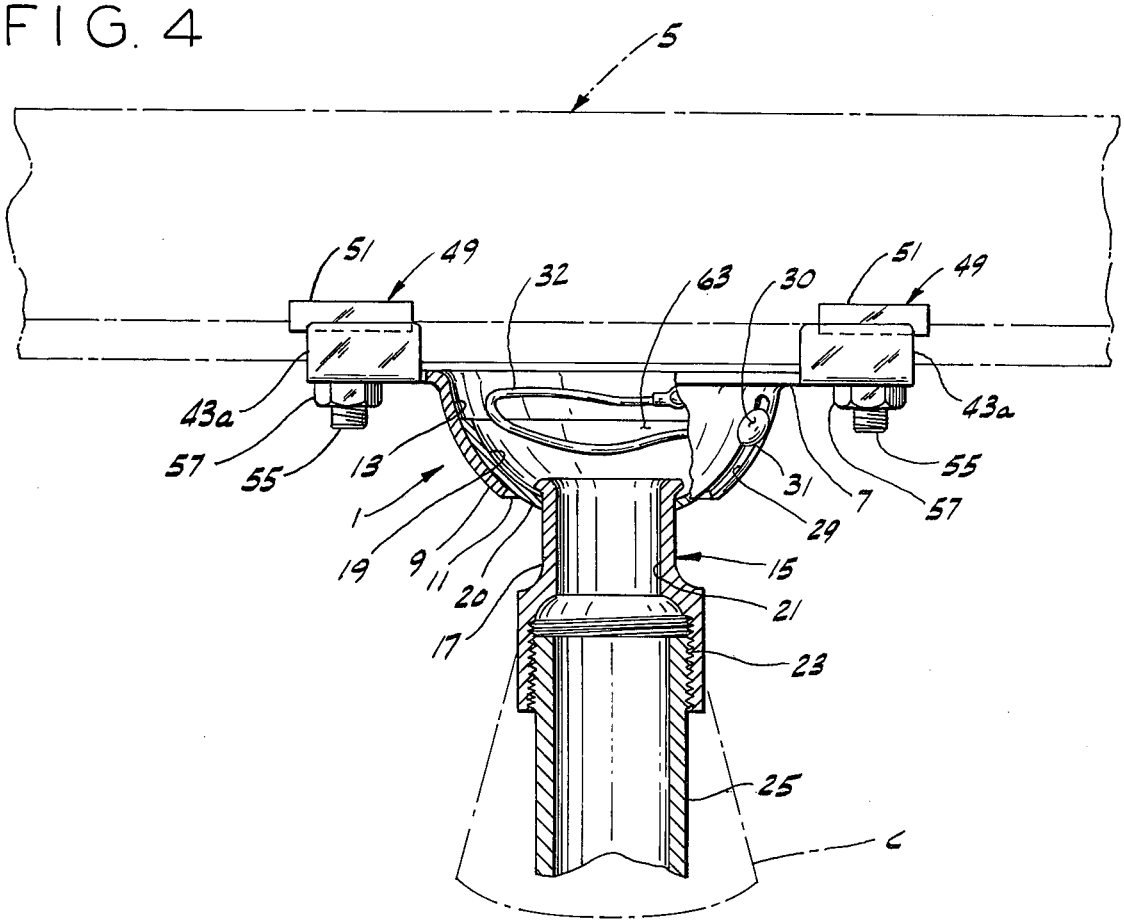
FIG. 4 is a side elevational view of the swivel connector of FIG. 3 with the path of swinging movement of a conduit secured to the swivel member of the connector being shown as a cone.

Referring now to the drawings, and particularly to FIGS. 1 and 2, a plurality of swivel connector assemblies of this invention, each of which is indicated in its entirety at 1, is shown to suspend a lighting fixture 3 from an overhead structure 5. As shown in FIGS. 3–5, swivel connector assembly 1 comprises a body plate 7 of relatively stiff sheet metal having a generally part-spherical dome 9 formed therein. This dome has an opening 11 therethrough at its center and an inner or concave part-spherical surface 13 (see FIG. 4). This inner or part-spherical surface forms a socket or a recess for purposes as will appear. The swivel connector further includes a swivel member 15 having a stem 17 and an enlarged part-spherical end 19 with an outer part-spherical surface 20 (see FIG. 4). Stem 17 is smaller than opening 11 and is insertable therethrough. Thus, with the stem inserted through the opening, end 19 is interengageable with the concave part-spherical surface 13 of dome 9 for being socketed therein so as to permit swiveling, sliding movement of the swivel member relative to body plate 7. As shown in FIG. 4, stem 17 and end 19 of swivel member 15 have an axial passage 21 therethrough. The stem has internal threads 23 for threadably receiving one end of a tubular conduit 25 or the like. Passage 21 in swivel member 15 receives one or more wires 27 which pass through the conduit for supplying electrical power to lighting fixture 3.

Dome 9 has a slot 29 therein extending in meridional direction from the edge of opening 11 toward body plate 7. Swivel end 19 has a pin 30 extending radially outwardly therefrom for reception in the slot 29 when end 19 is socketed in dome 9. Pin 30 has a head 31 at its outer end wider than slot 29. As best illustrated in FIGS. 3 and 4, a grounding wire 32 interconnects body plate 5 and swivel member 15 so as to insure that the latter is electrically common with the body plate. Grounding wire 32 is flexible and is of sufficient length so as to permit the swivel member to freely swivel in dome 9. End 19 of swivel member 15 are notched as indicated at 33, to provide clearance for the attachment of grounding wire 32 to body plate 5 thereby to permit the swivel member to swivel or swing without binding on the grounding wire attachment. It will be noted that slot 29 and pin 30 constitute means for limiting rotation of swivel member 15 relative to body plate 5 about its longitudinal axis (i.e., about the axis of passage 21). Thus, upon screwing conduit 25 into opening 23, the swivel member is held against rotation so as to prevent damage to grounding wire 32 and wires 27. It will be further noted that head 31 on pin 30 constitutes means for limiting axial movement of the swivel member into opening 11. This avoids damage to wires 27 and grounding wire 32 in the event lighting fixture 3 is inadvertently struck so as to cause the swivel member to be lifted or forced into the dome.

As best shown in FIGS. 2–4, swivel connector 1 of this invention is shown to be releasably secured to a channel-shaped support member constituting overhead support 5. This channel has spaced side flanges 35*a*, 35*b*, each of which has an inwardly turned, hook-shaped lip 37*a*, 37*b*, refining a slot S therebetween. Body plate 7 has identical end portions, each of which is indicated at 39, at opposite ends thereof, each of these end portions having an aperture 41 therethrough. Each end portion 39 has tabs 43*a*, 43*b* bent out of the plane of body plate 7 at each side of the body plate to extend along the sides of respective flanges 35*a*, 35*b* of channel 5 so as to keep the swivel connector assembly generally aligned with the channel. A cover plate 45 generally of the shape of body plate 7 overlies the recess in the body plate formed by dome 9. This cover plate has apertures 47 therethrough at its outer ends in register with apertures 41 in the body plate. A pair of stud nuts 49 is carried by the ends of the body plate. Each of these stud nuts has an enlarged head 51 somewhat wider than slot S and has grooves 53*a*, 53*b* in one face thereof for engagement with a respective lip 37*a*, or 37*b*. Each stud nut further has a threaded stud 55 secured to head 51 between grooves 53*a*, 53*b* with the stud extending through slot S for reception in the apertures 47 and 41 of cover plate 45 and body plate 7, respectively. Nuts 57 are threaded on studs 55 so that upon tightening of the nuts body plates 7 and cover plates 45 are drawn together and are clamped to the outer edges of flanges 35*a*, 35*b* thereby to releasably secure the swivel connector to the channel.

As best shown in FIG. 3, cover plate 45 has a central opening 59 therethrough for routing wires 27 from channel 5 to the passage 21 in swivel member 15 and to conduit 25. It will be understood that wires 27 and additional wires may be routed within channel 5.

In addition to being mounted on channel 5 as shown in FIGS. 3–5, swivel connector 1 may be mounted on the web of channel 5 opposite slot S by inserting stud nuts 49 through slots or knockouts (not shown) provided in the web of the channel.

With end 19 socketed in dome 9, swivel member 15 and conduit 25 may swing in any direction from an equilibtium position, as shown in FIGS. 3–5, in which the longitudinal centerline of the swivel member and the conduit are substantially aligned with the central axis of dome 9. More particularly, the centerline of the swivel member and the conduit are free to swing through an angle of 15° from its equilibrium position in any direction to generate a cone of movement, as indicated at C and as shown in phantom in FIGS. 3 and 4. It will be understood that by increasing clearance between stem 17 and the edge of opening 11 in dome 9 the angle through which the swivel member may swing may be increased.

Figure 6:
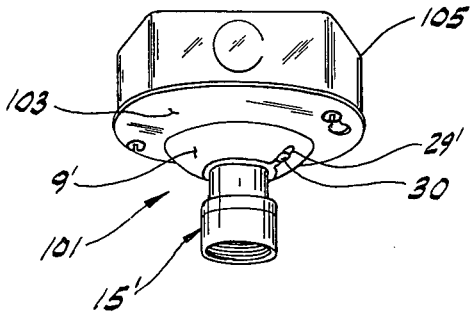
FIG. 6 is a perspective view of another embodiment of a swivel connector of this invention installed on an electrical outlet box.
Figure 7:
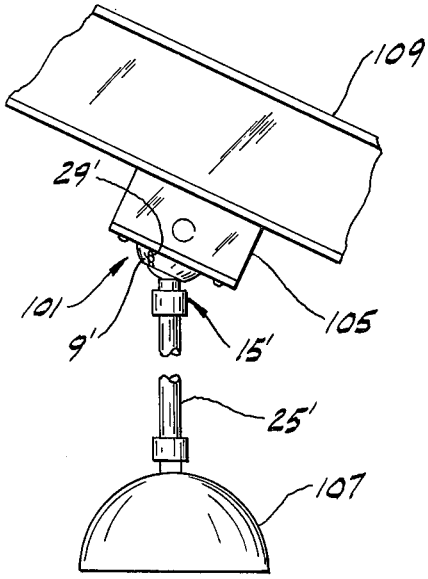
FIG. 7 is an elevational view of a swivel connector shown in FIG. 6 supporting a lamp and illustrating the self-righting or "self-plumbing" feature of this invention.

Referring now to FIGS. 6 and 7, a second embodiment of the swivel connector of this invention is indicated in its entirety at 101. Generally, swivel connector 101 is similar to swivel connector 1 heretofore described except for the differences hereinafter described. Parts of swivel connector 101 which are substantially identical to swivel connector 1 are indicated by "primed" reference characters. Swivel connector 101 has a generally circular body plate 103 adapted to be secured to a conventional electric outlet box 105. Body plate 103 has a dome 9′ formed therein for socketing a swivel member 15′ in such manner as to permit the swivel member to swing in any direction relative to the body plate (i.e., to swing within a conical path). With the exception that a cover plate is not required between body plate 103 and outlet box 105, all other parts of the swivel connector 101 are substantially identical to those heretofore described.

In FIG. 7, a lighting fixture 107, such as a mercury vapor lamp or the like, is suspended from a sloping overhead beam 109 by an outlet box 105 and a swivel connector 101. It will be noted that even though beam 109 is at an angle, conduit 25′ and lamp 107 are self-aligned (i.e., "self-plumbed") to assume a desired position in which the conduit is substantially vertical and the lamp is substantially level. It will also be noted that outlet box 105 need not be positioned on beam 109 so as to align the swing plane of the swivel connector with the slope of the beam because the swivel connector of this invention is free to swing in any direction relative to the outlet box As shown in FIG. 1, a lighting fixture 1 is supported by two pairs of swivel connectors 1 of this invention, each pair of swivel connectors including an upper swivel secured to channel 5, a lower swivel assembly secured to one end of the lighting fixture 1, and a length of conduit 25 screwed into threaded passages 23 of swivel member stems 17. In this manner the above-mentioned swivel connector assemblies, the conduits and the lighting fixture constitute a parallelorgram linkage for supporting the lighting fixture and for permitting the lighting fixture to swing in substantially any direction (see FIGS. 1 and 2) from its equilibrium position in the event the lighting fixture is inadvertently bumped thereby to lessen damage to the lighting fixture.

In view of the above, it will be seen that the several objects of this invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. A swivel assembly for mounting a lighting fixture or the like comprising a body member of relatively stiff sheet metal which has a generally spherical dome portion formed therein with the inner surface of said dome constituting a generally spherical concave surface, an opening through said body member at the center of said spherical dome portion, a swivel member having a part-spherical end portion larger than said opening, the outer surface of said end portion constituting a convex spherical surface portion of said swivel member, and a stem extending through said opening, said end portion being socketed in the concave surface of said dome for sliding movement of the end portion of the swivel member relative to the dome whereby said stem may swing in a conical path relative to said body member and for axial movement into said opening away from said inner surface of said dome, said stem being adapted to have a length of conduit or the like secured thereto, said swivel member having a passage therethrough for the reception of one or more wires which pass through the conduit so as to supply power to the lighting fixture, and means for limiting rotation of the swivel member about its longitudinal axis relative to said body member, said means for limiting rotation comprising a slot in said body member dome portion extending in generally meridional direction along said spherical dome portion from the edge of said opening therein and a pin secured to said end portion of said swivel member and extending out beyond the outer surface thereof for reception in said slot when said end portion is socketed in said dome portion.

2. A swivel assembly as set forth in claim 1 further having means for securement of said body member to an outlet box or the like.

3. A swivel assembly for mounting a lighting fixture or the like comprising a body member of relatively stiff sheet metal which has a generally spherical dome portion formed therein with the inner surface of said dome constituting a generally spherical concave surface, an opening through said body member at the center of said spherical dome portion, a swivel member having a part-spherical end portion larger than said opening, the outer surface of said end portion constituting a convex spherical surface portion of said swivel member, and a stem extending through said opening, said end portion being socketed in the concave surface of said dome for sliding movement of the end portion of the swivel member relative to the dome whereby said stem may swing in a conical path relative to said body member and for axial movement into said opening away from said inner surface of said dome, said stem being adapted to have a length of conduit or the like secured thereto, said swivel member having a passage therethrough for the reception of one or more wires which pass through the conduit so as to supply power to the lighting fixture, and means for limiting rotation of the swivel member about its longitudinal axis relative to said body member, said means for limiting rotation comprising a slot in said body member dome portion extending in generally meridional direction along said spherical dome portion from the edge of said opening therein and a pin secured to said end portion of said swivel member and extending out beyond the outer surface thereof for reception in said slot when said end portion is socketed in said dome portion, said swivel assembly being adapted for adjustable securement of said body member to a support channel at any selected position therealong, said support channel having a pair of side flanges with each flange having an inwardly turned hook-shaped lip, said lips being spaced from one another and defining a slot therebetween wherein said body member has portions at opposite ends thereof for engagement with said channel and fastener means carried by each of the end portions for releasably engaging said lips so as to releasably secure the body member to the channel.

4. A swivel assembly as set forth in claim 3 wherein each said body member end portion has a pair of tabs, one at each lateral side thereof, extending generally perpendicularly from said body member for engagement with the outer faces of said channel side flanges.

5. A swivel assembly as set forth in claim 3 further comprising a cover plate disposed between said body member and said channel, said cover plate overlaying the concave face of said dome portion so as to prevent removal of said swivel member from said dome portion.

6. A swivel assembly for mounting a lighting fixture or the like comprising a body member having a generally spherical surface portion, an opening through said body member at the center of said spherical surface portion, a swivel member having a generally spherical surface portion interengaging that of said body member for swiveling sliding movement relative thereto, said swivel member having a stem extending through said opening, said stem being adapted to have a length of conduit or the like secured thereto, said swivel member having a passage therethrough for the reception of one or more wires which pass through the conduit so as to supply power to the lighting fixture, and means for limiting rotation of the swivel member about its longitudinal axis relative to said body member, said assembly further comprising a flexible grounding wire interconnecting said body member and said swivel member for insuring that the latter is electrically common with the body member, said grounding wire permitting said swivel member to freely swivel relative to said body member.

7. A swivel assembly as set forth in claim 1 further comprising means carried by said swivel member engageable with said body member for limiting inward movement of said swivel member into said body member.

8. A swivel assembly as set forth in claim 7 wherein said means for limiting inward movement of said swivel member comprises a head on the outer end of said pin, said head being wider than said slot whereby upon said head engaging said body member the headed pin limits axial movement of said swivel member into said opening.

* * * * *